US005172672A

United States Patent [19]

Harada

[11] Patent Number: 5,172,672

[45] Date of Patent: Dec. 22, 1992

[54] EVAPORATIVE FUEL PURGE APPARATUS

[75] Inventor: Kenichi Harada, Susono, Japan

[73] Assignee: Toyota Jidosha Kabushiki Kaisha, Toyota, Japan

[21] Appl. No.: 859,931

[22] Filed: Mar. 30, 1992

[30] Foreign Application Priority Data

Apr. 11, 1991 [JP] Japan ..... 3-79146

[51] Int. Cl.[5] ..... F02M 33/02

[52] U.S. Cl. ..... 123/520; 123/519; 123/198 D

[58] Field of Search ..... 123/198 D, 518, 519, 123/520, 521, 516

[56] References Cited

U.S. PATENT DOCUMENTS

| | | | |
|---|---|---|---|
| 3,937,198 | 2/1976 | Sudhir | 123/519 |
| 4,446,838 | 5/1984 | Suzuki | 123/519 |
| 4,705,007 | 11/1987 | Plapp et al. | 123/519 |
| 4,790,283 | 12/1988 | Uranishi et al. | 123/516 |
| 4,817,576 | 4/1989 | Abe et al. | 123/516 |
| 4,821,701 | 4/1989 | Nankee, II et al. | 123/520 |
| 4,862,856 | 9/1989 | Yokoe et al. | 123/519 |
| 4,949,695 | 8/1990 | Uranishi et al. | 123/520 |
| 5,005,550 | 4/1991 | Bugin, Jr. et al. | 123/520 |
| 5,085,194 | 2/1992 | Kuroda et al. | 123/520 |
| 5,085,197 | 2/1992 | Mader et al. | 123/520 |
| 5,099,439 | 3/1992 | Saito | 123/520 |
| 5,103,794 | 4/1992 | Shiraishi | 123/520 |
| 5,111,795 | 5/1992 | Thompson | 123/519 |

FOREIGN PATENT DOCUMENTS

| | | |
|---|---|---|
| 26754 | 2/1990 | Japan . |
| 102360 | 4/1990 | Japan . |
| 61173 | 5/1990 | Japan . |
| 130255 | 5/1990 | Japan . |

OTHER PUBLICATIONS

Exerpt from Guidebook of Toyota Carina Ed, published Aug. 1991; pp. 2-17.

*Primary Examiner*—Tony M. Argenbright
*Assistant Examiner*—Thomas N. Moulis
*Attorney, Agent, or Firm*—Kenyon & Kenyon

[57] ABSTRACT

An evaporative fuel apparatus includes a first purge passage which connects a canister and an intake passage of an internal combustion engine and through which fuel vapor, stored in the canister, is purged into the intake passage, a control part provided in the first purge passage for controlling a flow of fuel vapor being fed from the canister to the intake passage, a detecting part for detecting a malfunction occurring in the control valve, a second purge passage which connects the canister and the intake passage and through which fuel vapor, stored in the canister, is purged into the intake passage, and a passage switching part for carrying out a passage switching to the second purge passage if a malfunction is detected by the detecting part, allowing the fuel vapor from the canister to be fed into the intake passage through the second purge passage.

8 Claims, 5 Drawing Sheets

EVAPORATIVE FUEL PURGE APPARATUS

BACKGROUND OF THE INVENTION (1) Field of the Invention

The present invention generally relates to an evaporative fuel purge apparatus, and more particularly to an evaporative fuel purge apparatus for an internal combustion engine in which fuel vapor evaporated in a fuel tank is stored in a canister and the fuel stored in the canister is fed into an intake passage of the engine.

(2) Description of the Related Art

In an evaporative fuel purge apparatus, fuel vapor, evaporated in a fuel tank, is fed into a canister containing activated carbon, the fuel vapor being adsorbed by the activated carbon of the canister so that the fuel vapor is stored in the canister, thus preventing the fuel vapor from escaping to the atmosphere. A purge passage connecting the canister and an intake passage of an internal combustion engine is provided in the evaporative fuel purge apparatus so that the stored fuel vapor is purged into the intake passage of the engine through the purge passage. A mixture of intake air and the fuel vapor in the intake passage is supplied to a combustion chamber of the engine via an intake value.

A flow rate of intake air into the intake passage is normally low when the engine is in an idling condition. Therefore, if the fuel stored in the canister is freely purged into the intake passage when the engine is in such a condition, it is difficult to maintain the stable operation of the engine. For example, the driveability deteriorates and the engine may stall. In order to eliminate this problem, a control valve is provided in the purge passage to control a flow of the fuel vapor being fed from the canister into the intake passage in response to the operating condition of the engine. However, if the control valve malfunctions, it is difficult to suitably control the flow of the fuel vapor from the canister to the intake passage to ensure the stable operation of the engine. Therefore, it is desirable that the evaporative fuel purge apparatus be provided with a safety unit for taking necessary measures when the control valve malfunctions.

In the prior art, there is an evaporative fuel purge device having a safety unit against a malfunction of a control valve in a purge passage. For example, Japanese Laid-Open Utility Model Application No.2-61173 discloses such a device. In this conventional device, a control valve is mounted in a purge passage connecting a canister and an intake passage for controlling a flow of fuel vapor being purged from the canister into the intake passage. In the purge passage downstream of the control valve, a diaphragm valve is provided. This diaphragm valve functions to close the purge passage when a throttle valve in the intake passage is switched to its closing position. If the control valve malfunctions and stops operating when it is still at its open position, the purge passage to the intake passage remains open. In such a case, the diaphragm valve is switched to its closing position, so that the purge passage is closed and the fuel vapor in the canister is not fed into the intake passage through the purge passage when the control valve malfunctions.

In the above mentioned evaporative fuel purge device, the function of the diaphragm valve is effective only when the control valve malfunctions and the purge passage to the intake passage remains open. However, if the control valve malfunctions when it is at its closing position, the purge passage is closed by the control valve and the fuel vapor is continuously supplied from the fuel tank to the canister, the canister finally overflowing since the quantity of fuel that can be stored in the canister is limited due to the capacity of the canister, so that excessive fuel vapor may escape from an opening of the canister to the atmosphere. Therefore, it is desirable to provide an evaporative fuel purge device having a safety unit that effectively functions even if the control valve malfunctions and the purge passage is closed.

SUMMARY OF THE INVENTION

Accordingly, it is a general object of the present invention to provide an improved evaporative fuel purge apparatus in which the above described problems are eliminated.

Another and more specific object of the present invention is to provide an evaporative fuel purge apparatus which can ensure the stable operation of the engine if the control valve malfunctions and stops operating when the purge passage is fully closed by the control valve. The above mentioned object of the present invention can be achieved by an evaporative fuel purge apparatus which includes a first purge passage which connects a canister and an intake passage of an internal combustion engine and through which fuel vapor, stored in the canister, is purged into the intake passage, a control valve provided in the first purge passage for controlling a flow of fuel vapor being fed from the canister to the intake passage, a detecting part for detecting a malfunction occurring in the control valve, a second purge passage which connects the canister and the intake passage and through which fuel vapor, stored in the canister, is purged into the intake passage, and a passage switching part for carrying out a passage switching if a malfunction in the control valve is detected by the detecting part, allowing the fuel vapor from the canister to be fed into the intake passage through the second purge passage. According to the present invention, it is possible to safely purge the stored fuel into the intake passage of the engine if the control valve should malfunction. Regardless of whether the first purge passage is opened or closed due to the malfunction of the control valve, it is possible to safely prevent the overflowing of the canister and the escaping of fuel vapor from the canister to the atmosphere.

Other objects and further features of the present invention will become apparent from the following detailed description when read in conjunction with the accompanying drawings.

DESCRIPTION OF THE PREFERRED EMBODIMENT

Figure 1:
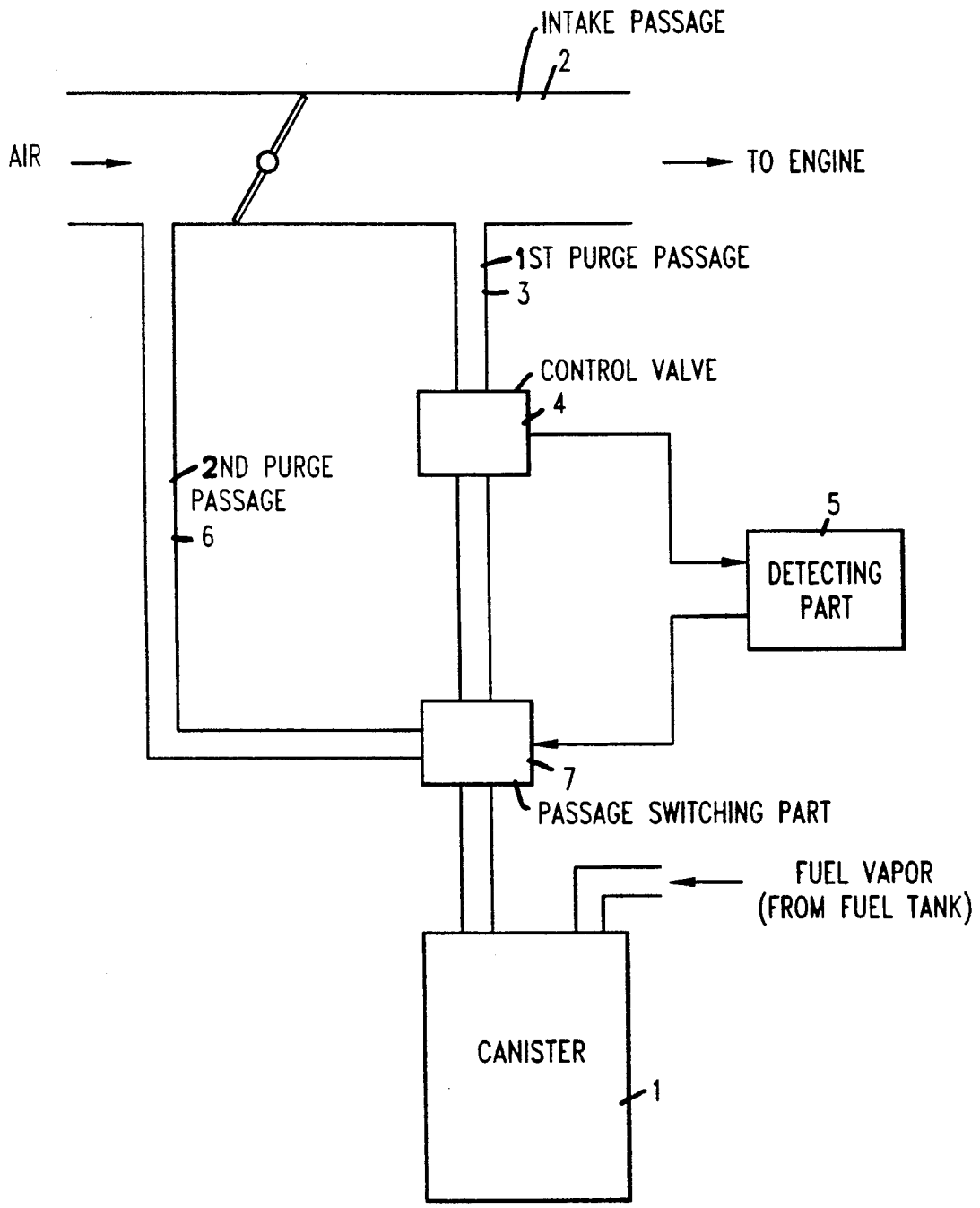
FIG. 1 is a block diagram showing an embodiment of an evaporative fuel purge apparatus according to the present invention.

A description will now be given of the construction of an evaporative fuel purge apparatus according to the present invention, with reference to FIG. 1. In FIG. 1, this evaporative fuel purge apparatus includes a first purge passage 3 which connects a canister 1 and an intake passage 2 of an internal combustion engine and through which fuel vapor, stored in the canister 1, is purged into the intake passage 2, a control valve 4 provided in the first purge passage 3 for controlling a flow of fuel vapor being fed from the canister 1 to the intake passage 2, a detecting part 5 for detecting a malfunction which takes place in the control valve 4, a second purge passage 6 which connects the canister 1 and the intake passage 2 and through which fuel vapor, stored in the canister 1, is purged into the intake passage 2, and a passage switching part 7 for carrying out a passage switching if a malfunction in the control valve 4 is detected by the detection part 5, allowing the fuel vapor from the canister 1 to be fed into the intake passage 2 through the second purge passage 6.

In the above described evaporative fuel purge apparatus, if the control valve 4 in the first purge passage 3 malfunctions, the malfunction is detected by the detecting part 5 and the passage switching part 7 is switched ON to select the second purge passage 6, instead of the first purge passage 3, so that the fuel is purged from the canister 1 into the intake passage 2 via the second purge passage 6. The first purge passage 3 in which the control valve has malfunctioned is not selected. Thus, it is possible to safely purge the fuel vapor stored in the canister 1 into the intake passage 2, regardless of whether the first purge passage is opened or closed due to the malfunction of the control valve 4.

Figure 2:
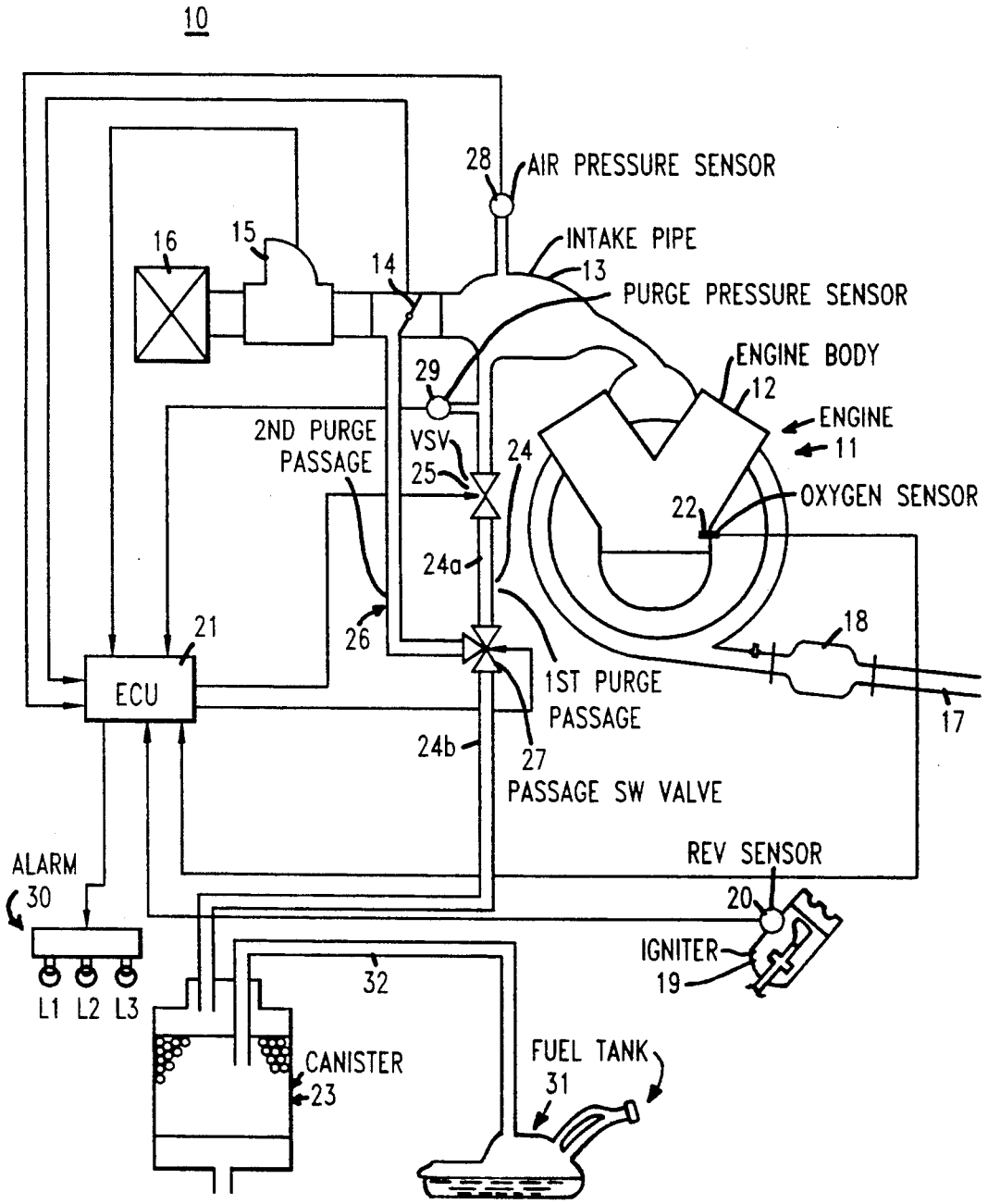
FIG. 2 is a view showing an internal combustion engine to which the present invention is applied.

Next, a description will be given of an internal combustion engine to which an embodiment of the present invention is applied, with reference to FIG. 2. In FIG. 2, an internal combustion engine 11 generally has an engine body 12, an intake system, an exhaust system, an ignition system, and a control unit. The intake system connected to the engine body includes an intake pipe 13, a throttle valve 14, an air flow meter 15 and an air cleaner 16. The exhaust system connected to the engine body includes an exhaust pipe 17 and a catalytic converter 18. An igniter 19 is provided in the ignition system, and a revolution sensor 20 is mounted on the igniter 19. This revolution sensor 20 detects a rotating speed of the engine 11. The control unit of the engine is an engine control unit (ECU) 21, and a throttle position signal sent from the throttle valve 14, an intake air signal sent from the air flow meter 15, an engine speed signal sent by the revolution sensor 20 and an oxygen signal sent by an oxygen sensor 22, mounted on the engine body 12, are input to the ECU 21. A fuel injection control process, an ignition timing control process and a diagnosis process are carried out by means of the ECU 21 on the basis of the above mentioned input signals. The ECU 21 is made up of a central processing unit (CPU), a read-only memory (ROM) and a random access memory (RAM), which are not shown in FIG. 2.

In FIG. 2, an evaporative fuel purge system 10 according to the present invention includes a canister 23, a first purge passage 24, a vacuum switching valve (VSV) 25, a second purge passage 26, a passage switching valve 27, an air pressure sensor 28, a purge pressure sensor 29, an alarm 30 and the ECU 21.

Fuel vapor, evaporated in a fuel tank 31, is fed into the canister 23 through a fuel supply passage 32. The canister 23 contains an adsorbent such as activated carbon, and the fuel vapor is adsorbed by this adsorbent in the canister 23 so that the fuel vapor from the fuel tank 32 is stored in the canister 23. The first purge passage 24 connects the canister 23 and the intake pipe 13, and the first purge passage 24 is joined to the intake pipe 13 at a portion of the intake pipe downstream of the throttle valve 14. At intermediate portions of the first purge passage 24 between the intake pipe 13 and the canister 23, the passage switching valve 27, the VSV 25 and the purge pressure sensor 29 are mounted, in this order. The first purge passage 24 is divided by the passage switching valve 27 into a purge line 24*a* on the intake pipe side and a purge line 24*b* on the canister side.

The passage switching valve 27 in this embodiment is, for example, a three-way vacuum switching valve (VSV) whose switching operation is controlled by a control signal sent to the valve so that either one fluid passage or the other is selected. In this embodiment, the second purge passage 26 is provided to connect the passage switching valve 27 and the intake pipe 13. The passage switching valve 27 is coupled to the ECU 21, and the valve 27 carries out a passage switching in response to a control signal sent by the ECU 21, so that the purge line 24*b* is connected to selectively either the purge line 24*a* or the second purge passage 26. The purge line 24*b* is connected to the second purge passage 26 when the valve 27 is switched ON by the control signal, and it is connected to the purge line 24*a* when the valve 27 is switched OFF by the control signal. Thus, it is possible to supply the fuel vapor from the canister 23 to the intake passage of the engine through selectively either the first purge passage 24*a* or the second purge passage 26 by means of a control signal sent by the ECU 21 to the passage switching valve 27. It should be noted that the second purge passage 26 is joined to the intake pipe 13 at a portion of the intake pipe immediately upstream of the throttle valve 14 when the throttle valve is set to the closed position.

The VSV 25 is coupled to the ECU 21, and the switching operation of this valve is controlled by a control signal sent by the ECU 21 to the VSV 25. The VSV 25 carries out a switching operation in response to this control signal, so that the first purge passage 24 is opened when the VSV 25 is switched ON, or it is closed when the VSV 25 is switched OFF. The purge pressure sensor 29 is mounted in the first purge passage 24 between the VSV 25 and the intake pipe 13, to detect the pressure of fuel vapor within the purge line 24*a*. A signal indicative of the purge line pressure detected by the sensor 29 is input to the ECU 21. The air pressure sensor 28 is mounted in the intake pipe 13 to detect the pressure of air-fuel mixture in the intake pipe 13. A signal indicative of the intake pipe pressure detected by the sensor 28 is input to the ECU 21.

The alarm 30 includes three lamps L1, L2 and L3 and a lamp driving circuit, and this alarm 30 is mounted, for example, in an instrument panel of an automotive vehicle. The lamps of the alarm 30 are turned ON when a malfunction in the evaporative fuel purge apparatus is detected during the diagnosis process performed by the ECU 21, so that a warning about the malfunction is given to a driver, and the driver is notified as to where the malfunction has occurred in the evaporative fuel purge apparatus.

Next, a description will be given of the diagnosis process performed by the ECU 21 in the evaporative fuel purge apparatus according to the present invention. The operations of the apparatus are controlled by means of the ECU 21. A program for executing the diagnosis process is stored in the ROM provided in the ECU 21. The function of the detecting part according to the present invention is achieved by the execution of the diagnosis process. In this embodiment, the diagnosis process is carried out by the ECU 21 at time intervals of 12 msec.

Figure 3A:
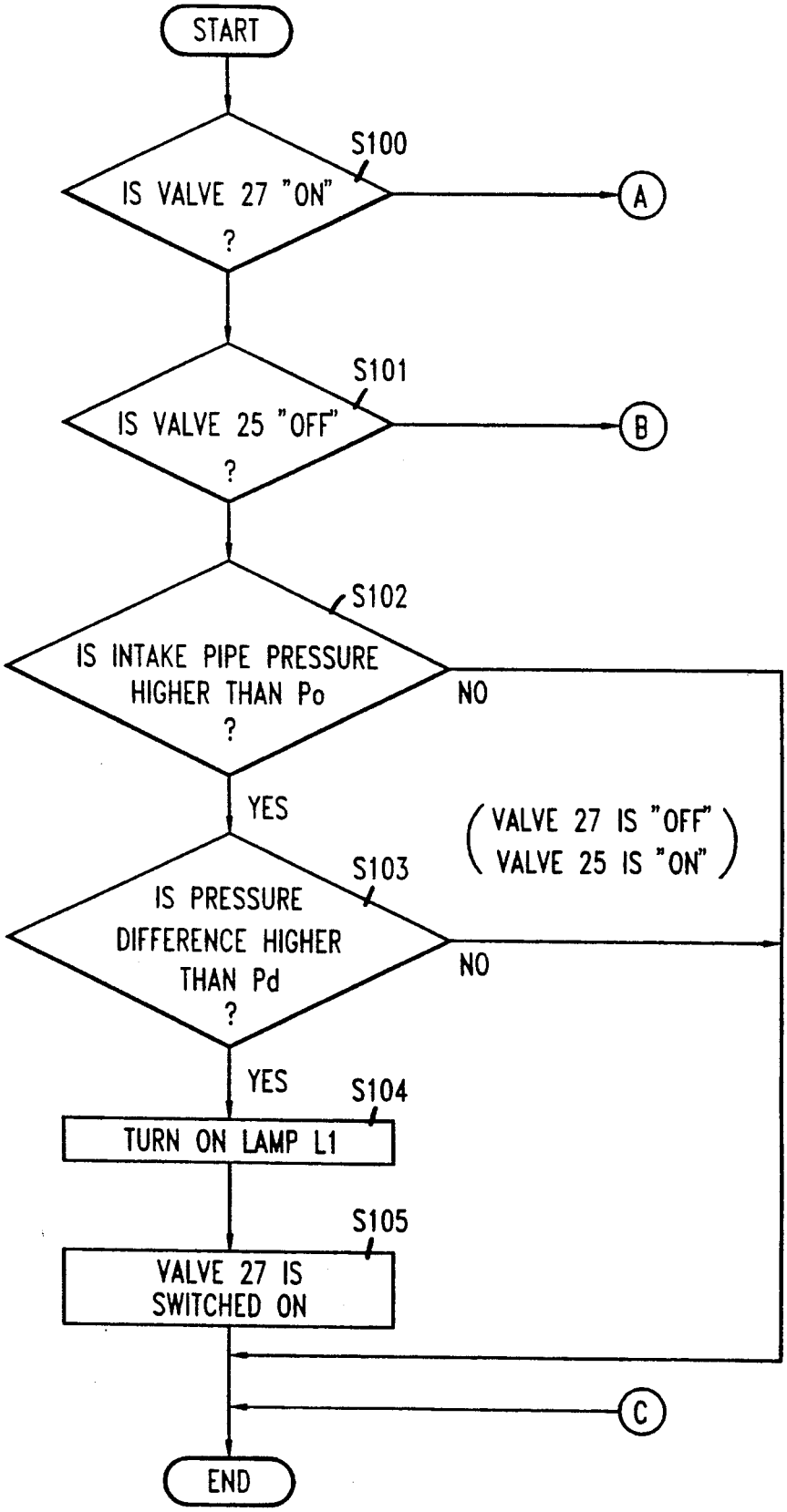
FIG. 3A is a flow chart for explaining a main routine of a diagnosis process performed by a control unit according to the present invention.
Figure 3B:
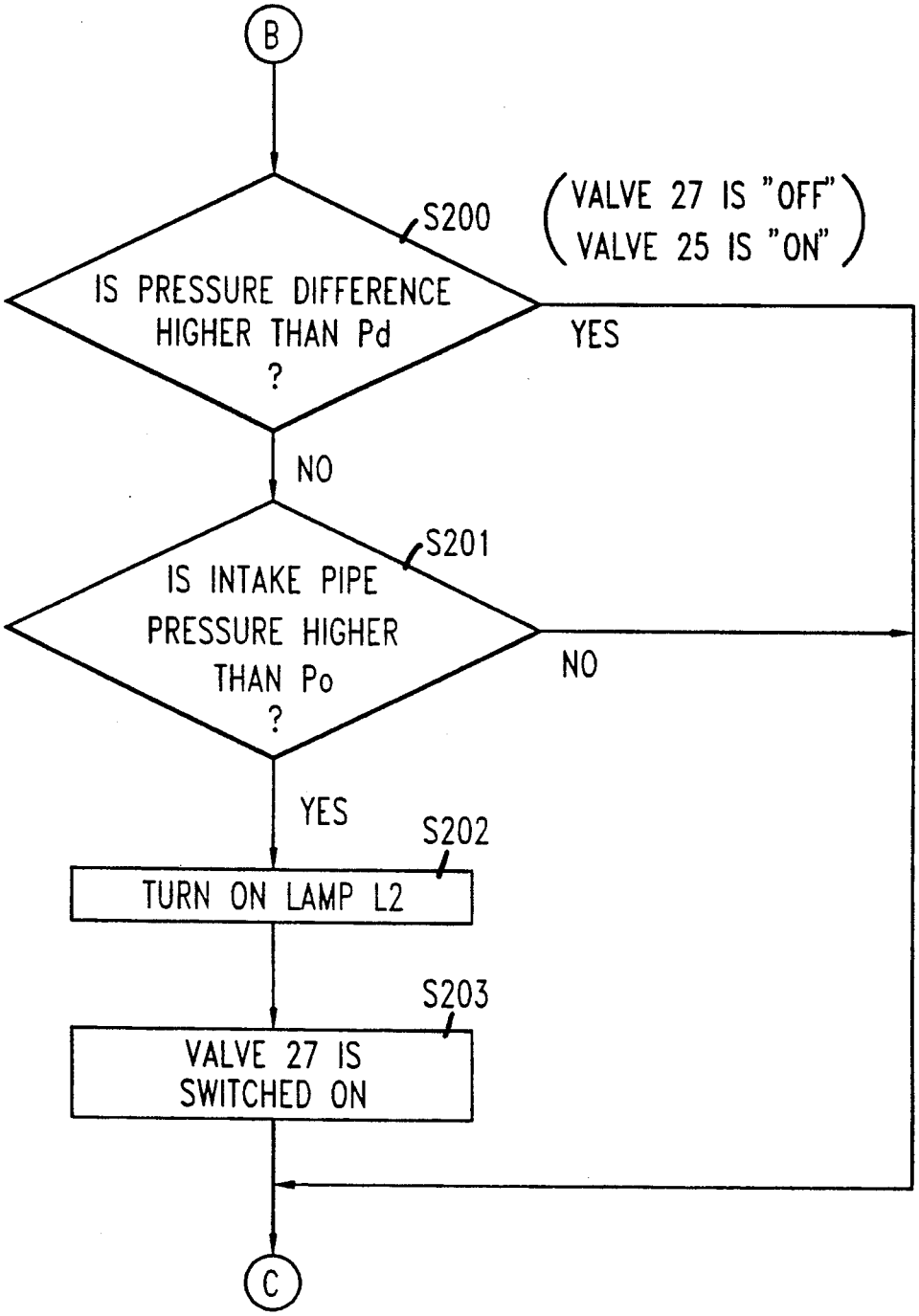
FIG. 3B is a flow chart for explaining a routine of the diagnosis process shown in FIG. 3A, which routine is performed to detect whether or not a control valve malfunctions and to detect whether or not a first purge passage is closed due to the malfunction.
Figure 3C:
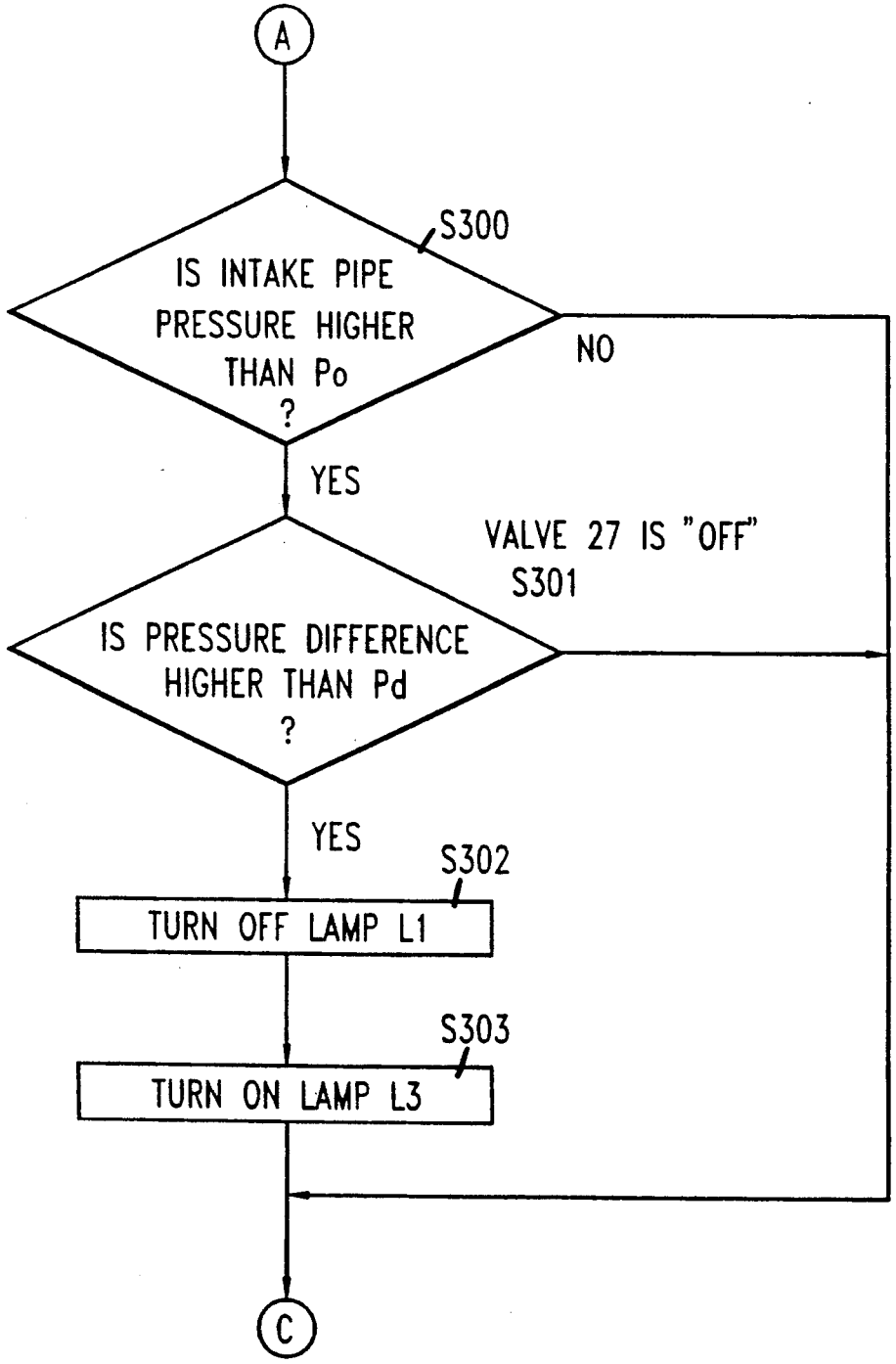
FIG. 3C is a flow chart for explaining a routine of the diagnosis process shown in FIG. 3A, which routine is performed to detect whether or not the first purge passage leaks.

FIG. 3 shows a main routine of the diagnosis process performed by means of the ECU 21. Once the diagnosis process is started, the ECU 21 detects whether or not the passage switching valve 27 is switched ON in step S100. If it is detected in step S100 that the valve 27 is switched ON and that the purge line **24*b* is connected to the second purge passage 26 via the valve 27, then the procedure is transferred to step S300 in a routine shown in FIG. 3C. If it is detected in step 100 that the valve 27 is switched OFF and that the purge line 24*b* is connected to the purge line 24*a* via the valve 27, then step 101 detects whether or not the VSV 25 is switched OFF. If it is detected in step 101 that the VSV 25 is switched ON and that the first purge passage 24 is opened by the VSV 25, then the procedure is transferred to step S200 in a routine shown in FIG. 3B. If it is detected that the VSV 25 is switched OFF, then step S102** is performed.

The switching ON/OFF of the VSV 25 is controlled by means of the ECU 21. If it is detected in response to the signals sent from the air flow meter 15 and the revolution sensor 20 that the engine is in an operating condition suitable for the purging of the fuel in the canister 23 into the intake pipe 13, the VSV 25 is switched ON by a control signal sent by the ECU 21. A suitable operating condition of the engine is, for example, a high-speed operating condition. If it is detected that the engine is in an operating condition unsuitable for the purging of the fuel into the intake pipe 13, the VSV 25 is switched OFF by a control signal sent by the ECU 21. An unsuitable operating condition of the engine is, for example, an idling condition or an engine warm-up condition.

As described above, the diagnosis process performed by the ECU 21 is divided into three different routines depending on the results of the signal detections in steps S100 and S101. The routine of steps S102 through S105 shown in FIG. 3A is a diagnosis process, which is performed, after it is confirmed in response to the signal that the VSV 25 has been switched OFF, for detecting whether or not a malfunction has occurred in the VSV 25 and detecting whether or not the first purge passage has been opened due to the malfunction of the VSV 25.

In the routine of steps 102 through S105 shown in FIG. 3A, it is detected in response to the received signal that the purge line **24*a* and the purge line 24*b* of the first purge passage are connected to each other via the valve 27, and that the VSV 25 is switched OFF. The ECU 21 detects in step S102, in response to an intake pipe pressure signal sent by the sensor 28, whether or not the intake pipe pressure is higher than a predetermined level Po (which level is below the atmospheric pressure). If the intake pipe pressure is lower than the level Po, it is difficult to detect accurately a difference between the intake pipe pressure and the purge line pressure, and thus detecting of a malfunction in the valve 25** in this condition is not reliable. Thus, if the intake pipe pressure is lower than the level Po, the diagnosis process is not performed and the process ends immediately.

If it is detected in step S102 that the intake pipe pressure is higher than the level Po and that conditions are suitable for performing the diagnosis process, step 103 detects, in response to an intake pipe pressure signal sent by the sensor 28 and a purge line pressure signal sent by the sensor 29, whether or not a difference between the intake pipe pressure and the purge line pressure is higher than a predetermined value Pd. It is confirmed in step S101 that the VSV 25 has been switched OFF. If the VSV 25 functions normally, fuel vapor is not purged from the purge line **24*a* into the intake pipe 13 and the intake pipe pressure is almost the same as the purge line pressure. Therefore, if it is detected in step 103 that the pressure difference is not higher than the value Pd, the ECU 21 judges that the VSV 25** is functioning normally, and the diagnosis process ends.

However, if it is detected that the pressure difference is higher than the value Pd, the ECU 21 judges that the VSV 25 has malfunctioned and the first purge passage 24 to the intake pipe 13 is opened due to the malfunction. The ECU 21 then instructs the alarm 30 to turn the lamp L1 ON in step S104. The lamp L1 in the ON state indicates to a vehicle driver that the VSV 25 has malfunctioned and the first purge passage 24 is incorrectly opened. In step S105, the passage switching valve 27 is switched ON so that the purge line **24*b* is connected to the second purge passage 26 via the passage switching valve 27, and the first purge passage 24 is closed by the valve 27. Thus, the fuel vapor from the canister 23 is purged into the intake pipe 13 through the second purge passage 26. The second purge passage 26 is joined to the intake passage at an outlet portion immediately upstream of the throttle valve 14, and a port purging is performed from this outlet portion of the second purge passage 26**.

When the VSV 25 malfunctions and the first purge passage 24 is opened incorrectly, the air-fuel mixture fed into the engine 12 becomes excessively lean, and such problems as a defective idling condition, engine stalling and a defective re-starting condition may take place. According to the present invention, it is possible to safely and with no problems purge the fuel into the intake passage if the VSV 25 malfunctions and the first purge passage 24 is incorrectly opened.

Next, the routine of steps S200 through S203 will be described, with reference to FIG. 3B. This routine is a diagnosis process which is carried out to detect whether or not a malfunction has occurred in the VSV 25 and whether or not the first purge passage 24 has been closed due to the malfunction of the VSV 25. In the routine of steps 200 through S203 shown in FIG. 3B, it is detected in response to the received signal that the purge line **24*a* and the purge line 24*b* are connected to each other via the valve 27, and that the VSV 25 is switched ON. Step 200 detects, in response to an intake pipe pressure signal sent by the sensor 28 and a purge line pressure signal sent by the sensor 29, whether or not a difference between the intake pipe pressure and the purge line pressure is higher than the predetermined value Pd. Since it has been detected that the VSV 25 is switched ON, if the VSV 25 functions normally, fuel vapor is purged from the purge line 24*a* into the intake pipe 13, the purge line pressure (which is below the atmospheric pressure) being lower than the intake pipe pressure (which is almost equal to the atmospheric pressure). Therefore, if it is detected in step 200 that the pressure difference is higher than the value Pd, the ECU 21 judges that the VSV 25** is functioning normally, and the diagnosis process ends.

However, if it is detected that the pressure difference is lower than the value Pd, or that the purge line pressure is almost equal to the intake pipe pressure, the ECU 21 judges that the VSV 25 has malfunctioned and the first purge passage is incorrectly closed due to the malfunction. Then, step S201 detects whether or not the intake pipe pressure is higher than the level Po. If the intake pipe pressure is lower than the level Po, the pressure difference detected in step S200 is inaccurate, and thus detecting of a malfunction in the valve 25 under this condition is not reliable. Thus, if the intake pipe pressure is lower than the level Po, the following steps are not performed and the diagnosis process ends immediately.

If it is detected in step S201 that the intake pipe pressure is higher than the level Po, step S202 instructs the alarm to turn the lamp L2 ON. The lamp L2 in the ON state indicates to a vehicle driver that the VSV 25 has malfunctioned and the first purge passage 24 is incorrectly closed. In step S203, the passage switching valve 27 is switched ON so that the purge line **24*b* is connected to the second purge passage 26 via the valve 27, and the first purge passage 24 is closed by the valve 27. Hence, the fuel vapor from the canister 23 is purged into the intake pipe 13 through the second purge passage 26, thereby preventing the overflowing of the canister due to the malfunctioning of the VSV 25 and due to the first purge passage 24 being closed. A port purging is performed from the above described outlet portion of the second purge passage 26**.

Next, the routine of steps S300 through S303 will be described, with reference to FIG. 3C. This routine is a diagnosis process which is carried out to detect whether or not the first purge passage 24 leaks due to a crack or the like therein. In the routine of steps S300 through S303 shown in FIG. 3C, it is detected in response to the received signal that the purge line **24*b* is connected to the second purge passage 26 via the passage switching valve 27. In other words, the ECU 21 detects a malfunctioning of the VSV 25, and the first purge passage 24 is incorrectly opened or closed due to the malfunction. Step S300 detects, in response to an intake pipe pressure detected by the sensor 28, whether or not the intake pipe pressure is higher than the level Po. If the intake pipe pressure is lower than the level Po, a pressure difference detected between the intake pipe pressure and the purge line pressure is inaccurate, and detecting of a malfunctioning of the valve 25 under this condition is not reliable. Thus, if it is detected in step S300** that the intake pipe pressure is lower than the level Po, the following steps are not performed and the process ends immediately.

If step S300 detects that the intake pipe pressure is higher than the level Po and that the conditions are suitable for performing the diagnosis process, then step 301 detects, in response to the intake pipe pressure signal sent by the sensor 28 and a purge line pressure signal sent by the sensor 29, whether or not a pressure difference between the intake pipe pressure and the purge line pressure is higher than the value Pd. In step S100 it is confirmed that the valve 27 is switched ON, and that the purge line **24*b* is connected to the second purge passage 26. As described above, when the VSV 25 malfunctions and the first purge passage 24 is incorrectly opened, the intake pipe pressure is almost the same as the purge line pressure, and the pressure difference is substantially equal to zero. Therefore, if it is detected in step S301 that the pressure difference is not higher than the value Pd, the ECU 21 judges that the VSV 25** has malfunctioned and the first purge passage is incorrectly opened, and the following steps are not performed and the process ends immediately.

However, if it is detected that the pressure difference is higher than the value Pd, the ECU 21 judges that the purge line **24*a* of the first purge passage 24 is leaking incorrectly. The ECU 21 then instructs the alarm 30 to turn the lamp L1 OFF in step S302. In step S303, the ECU 21 instructs the alarm 30** to turn the lamp L3 ON. The lamp L3 in the ON state indicates to a vehicle driver that there is a leakage in the evaporative fuel purge apparatus, thus allowing the defective apparatus to be fixed early.

In the above described embodiment, the first purge passage 24 in which the passage switching valve 27 is mounted, and the second purge passage 26 which is connected at an intermediate portion of the first purge passage 24 are applied. However, the present invention is not limited to this embodiment. For example, a modified apparatus in which a second purge passage having the same structure as that of the first purge passage is mounted in parallel with the first purge passage is also applicable.

As described in the foregoing, if the control valve in the first purge passage should malfunction, it is possible for the present invention to detect the malfunctioning of the control valve and switch the purge passage to the second purge passage, so that the fuel stored in the canister is safely purged into the intake passage through the second purge passage. Regardless of whether the first purge passage is opened or closed due to the malfunction of the control valve, the stored fuel vapor can be supplied from the canister to the intake passage, thus preventing the overflowing of the canister as well as the escaping of fuel vapor to the atmosphere.

Further, the present invention is not limited to the above described embodiment, and variations and modifications may be made without departing from the scope of the present invention.

What is claimed is:

1. An evaporative fuel purge apparatus comprising:

a first purge passage which connects a canister and an intake passage of an internal combustion engine and through which fuel vapor, stored in the canister, is purged into the intake passage;

a control valve provided in said first purge passage for controlling a flow of fuel vapor being fed from the canister to the intake passage;

detecting means for detecting a malfunction that occurs in said control valve;

a second purge passage which connects the canister and the intake passage and through which fuel vapor, stored in the canister, is purged into the intake passage; and passage switching means for carrying out a passage switching from said first purge passage to said second purge passage if a malfunction in said control valve is detected by said detecting means, allowing the fuel vapor from the canister to be fed into the intake passage through said second purge passage.

2. An apparatus according to claim 1, wherein said detecting means detects a malfunction occurring in the control valve by checking whether or not a pressure difference between an intake passage pressure and a first purge passage pressure is higher than a predetermined value.

3. An apparatus according to claim 1, wherein said detecting means includes a control unit, a first sensor, coupled to the control unit, for detecting a pressure in the intake passage, and a second sensor, coupled to the control unit, for detecting a pressure in the first purge passage, said detecting means thus detecting, in response to the pressure detected by the first sensor and that detected by the second sensor, whether or not a pressure difference between the pressure detected by the first sensor and that detected by the second sensor is higher than a predetermined value.

4. An apparatus according to claim 2, wherein said detecting means detects that the control valve malfunctions and the first purge passage is open, if a pressure difference between an intake passage pressure and a first purge passage pressure is higher than the predetermined value when the control valve is in OFF state and the second purge passage is disconnected from the canister.

5. An apparatus according to claim 2, wherein said detecting means detects that the control valve malfunctions and the first purge passage is closed, if a pressure difference between an intake passage pressure and a first purge passage pressure is not higher than the predetermined value when the control valve in ON state and the second purge passage is disconnected from the canister.

6. An apparatus according to claim 2, wherein said detecting means detects that the first purge passage leaks, if a pressure difference between an intake passage pressure and a first purge passage pressure is higher than the predetermined value when the second purge passage is disconnected from the canister.

7. An apparatus according to claim 1, wherein said passage switching means is a three-way vacuum switching valve that is switched ON and OFF by a signal sent by a control unit, so that said first purge passage is disconnected from the canister and said second purge passage is connected to the canister when said valve is in ON state, and that said first purge passage is connected to the canister and said second purge passage is disconnected from the canister when said valve is in OFF state.

8. An apparatus according to claim 1, wherein said second purge passage is connected to an intermediate portion of said first purge passage, said passage switching means being provided in said first purge passage at said intermediate portion where the second purge passage is connected to the first purge passage, said first purge passage being divided into two passage sections by the passage switching means.

* * * * *